United States Patent [19]

Rasmussen et al.

[11] Patent Number: 4,740,187

[45] Date of Patent: Apr. 26, 1988

[54] ROBOT VEHICLE CARRIER

[75] Inventors: Russell G. Rasmussen, Skokie; Harry Disko, South Barrington, both of Ill.

[73] Assignee: Marvin Glass & Associates, Chicago, Ill.

[21] Appl. No.: 7,770

[22] Filed: Jan. 28, 1987

[51] Int. Cl.[4] ..... A63H 3/00

[52] U.S. Cl. ..... 446/73; 446/268; 446/430; 446/309; 206/457

[58] Field of Search ..... 446/73, 72, 75, 76, 446/423, 290, 435, 430, 429, 309, 268; 206/216, 457

[56] References Cited

U.S. PATENT DOCUMENTS

| | | | |
|---|---|---|---|
| 2,052,594 | 9/1936 | Antel | 446/73 |
| 3,106,038 | 10/1963 | Patton | 446/423 X |
| 4,141,175 | 2/1979 | Barlow et al. | 446/290 |
| 4,192,093 | 3/1980 | Hamano | 446/435 X |
| 4,571,198 | 2/1986 | Barbato et al. | 446/73 |

*Primary Examiner*—Mickey Yu

*Attorney, Agent, or Firm*—John S. Pacocha

[57] ABSTRACT

A toy robot having a handle, one or more small vehicle-receiving recesses provided in its head and/or on its torso and limbs and blade-like supporting posts for vehicle track members. Certain of the robot's vehicle-receiving recesses may have associated therewith vehicle-propelling means and/or track member mounting posts whereby to permit the provision of exit ramps therefrom. The robot serves not only as an independent toy and as a small vehicle carrier, but also permits cooperative play action between the robot and the small vehicles.

20 Claims, 3 Drawing Sheets

10
20
20b
134
2
140
142
98
90
96
37
16
38
20a
90a
86
46
92
50
42
4
100
22
94
102
110
104
88
107
130
106
112
48
18
12
14
64
82
60
62
62a
24
84
70
70a
68
80
76
77
26

20b
134
36
30
30a
32a
32b
20
34
32
20a
38
37
28
136
50
50a
138
52
46
44
12
138
50
48
40
16
18
14
46
64
66
62
50
62a
60
82
24
72
74
70
50
68
70a
84
76
26
78
77
114
116
80
126
124
129
120
128
122
118
56b
56a
54
58c
58b
56
50a
58a
58
50

ROBOT VEHICLE CARRIER

BACKGROUND OF THE INVENTION

1. Field of the Invention

This invention relates generally to a carrier and/or a storage facility for small free-wheeling toy vehicles in the form of an articulated toy robot wherein the inclusion of track members and vehicle propelling means on the robot permits play action involving both the toy vehicles and the robot itself.

2. Background Art

Carrying cases for small vehicles are very popular with youngsters who wish to have their vehicle collections with them when playing away from home. Some such carrying cases have even been in special shapes such as the MATTEL Racer Engine Case carrier and the MATCHBOX Steering Wheel Twenty Car carrier but these two vehicle carriers are still of the case type including two hinged members with a series of vehicle compartments being provided in one of the members and with the other member merely serving as a cover. Carrying case toys including vehicles and track/ramp members are also popular, such as the MATTEL FIRST WHEELS Railroad, Airport and Garage and the MATTEL Construction Site, CITY and Service Center STO & GO Playsets. However, there remains a need for additional vehicle carriers wherein the carrier itself serves as a separate toy.

SUMMARY OF THE INVENTION

The present invention is concerned with providing an articulated toy robot which may also be used for either storing or transporting a plurality of small vehicles and/or for play action involving the vehicles with the robot carrier. These and other objects and advantages of the invention are achieved by providing an articulated toy robot having a torso, a head, arms, legs and feet with vehicle-receiving recesses providing in each of same including releasable means for retaining small free-wheeling vehicles in such recesses. The toy robot also has a handle, means in certain of the recesses for propelling a vehicle therefrom, and means for supporting several interconnectable track members, which may either be used to provide a road bed for the vehicles, or which may be used as ramps from certain of the vehicle-receiving recesses, including those with vehicle propelling means.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
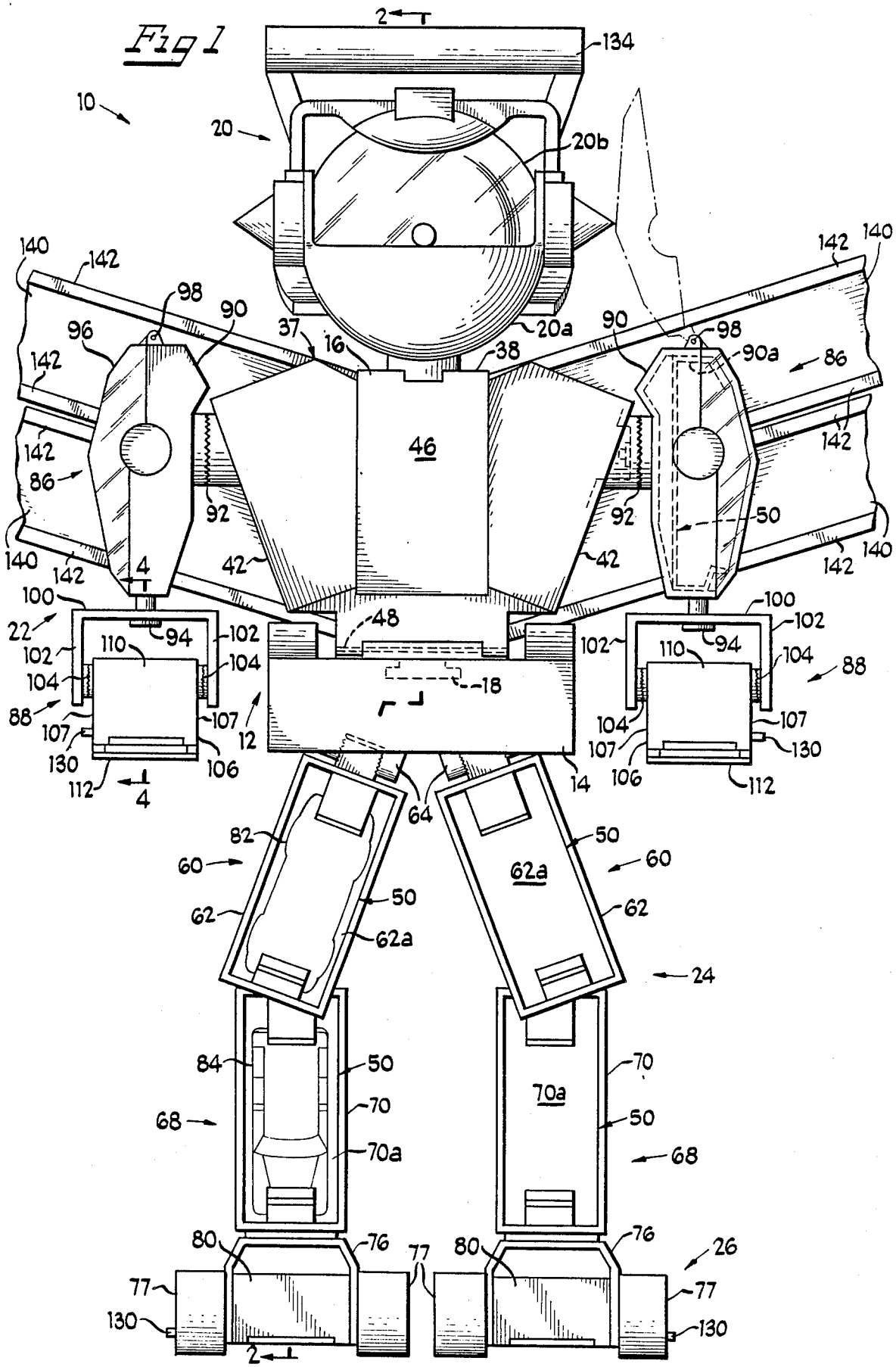
FIG. 1 is a front elevational view of a toy robot vehicle carrier embodying the present invention.

Referring now to the drawings in which like parts are designated by like reference numerals throughout the several views, there is shown in FIG. 1 an articulated toy robot 10 formed primarily of plastic parts and having a two-part torso 12 including a lower portion 14 and an upper portion 16 rotatably supported on the lower portion 14 by a suitable swivel fastener 18. The toy robot 10 is also provided with a two-part, generally spherical head 20 and the usual limbs, including a pair of arms 22 and a pair of legs 24 with attached feet 26 for supporting the robot 10 in an upright position. As will be more fully described hereinafter, the robot's head 20, torso 12 and limbs may also be provided with vehicle-receiving recesses together with releasable means for retaining small free-wheeling vehicles therein for either storage or for transport from place to place.

Figures 2, 2A:
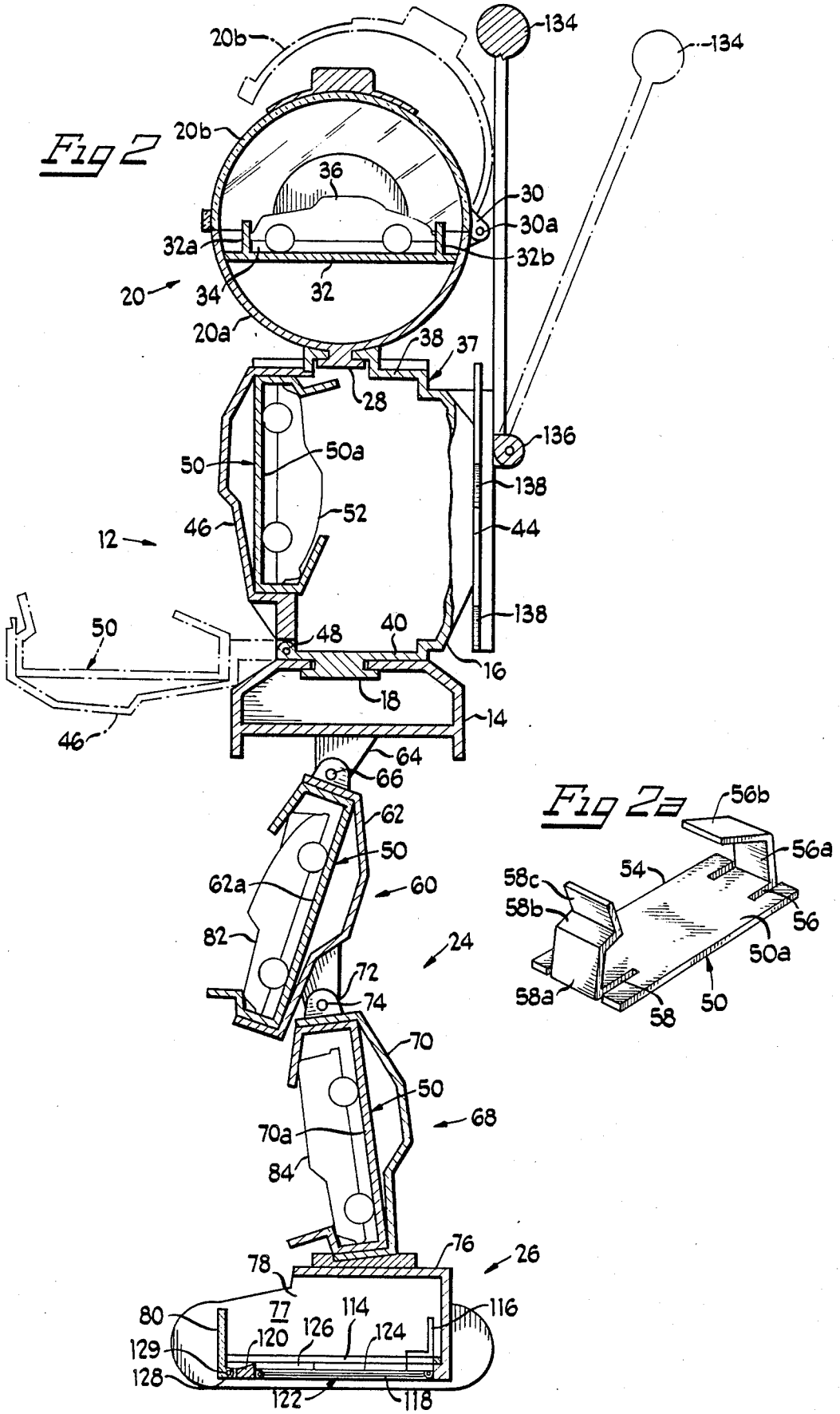
FIG. 2 is a vertical sectional view taken generally along line 2—2 of FIG. 1.
FIG. 2*a* is a perspective view of one of the vehicle-receiving clips shown in FIG. 2.

As best shown in FIG. 2, a lower part 20*a* of the robot head 20 is rotatably mounted on the upper portion 16 of the torso 12 by a suitable swivel fastener 28. An upper part 20*b* of the head 20 is pivotally connected to the rear of the lower part 20*a* by a hinge mechanism 30 for upward and downward pivoting movement of the upper part 20*b* about a hinge pin 30*a* between "open" and "closed" positions, respectively. A horizontal wall structure 32 having upwardly projecting, spaced apart front and rear wall portions 32*a* and 32*b*, respectively, is provided in the lower part 20*a* of the robot head 20 to define a vehicle-receiving recess 34 for a small vehicle 36. The upper part 20*b* of the robot head 20 serves as releasable means for retaining the vehicle 36 in the recess 34.

The upper portion 16 of the torso 12, which is hollow, is characterized by a main body portion 37 having a top wall 38, a bottom wall 40, sidewalls 42 and a rear wall 44, all of which are integrally formed, and by a separate front wall 46, which is pivotally connected to the forward edge of the bottom wall 40 for pivotal movement about a horizontal axis 48. Frictional latch means may be provided to retain the front wall 46 in its raised or "closed" position, as is shown in full line in FIG. 2, the lowered or "open" position being shown in broken line. A clip 50 (FIGS. 2 and 2*a*) defining a vehicle-receiving recess 50*a* is provided on the inner surface of the torso front wall 46 and a small vehicle 52 is shown supported therein. If desired and permitted by space considerations, a pair of clips 50 could be provided side-by-side on the inner surface of torso front wall 46. Further, although not shown in the drawings, suitable vehicle-receiving recess means could be provided on the outer surface of front wall 46 of robot torso 12.

As best illustrated in FIG. 2*a*, clip 50 has a flat, generally rectangular support member 54 with a first tab portion 56 cut out of one end and including upwardly and inwardly directed extension portions 56*a* and 56*b*, respectively, defining a flexible retainer/support for one end of a small toy vehicle. A second tab portion 58 cut out of the opposite end of support member 54 and having upwardly, inwardly and upwardly directed extension portions 58*a*, 58*b* and 58*c*, respectively, defining a slightly more flexible retainer/support for the opposite end of the small toy vehicle. Extension portion 58*c* facilitates insertion of a vehicle into the clip and manual deflection of tab portion 58 for removal of the vehicle. As is clearly evident from the drawings, each clip 50 defines a vehicle-receiving recess with flexible tabs 56 and 58 defining releasable vehicle-retaining means.

Each leg 24 includes an upper leg portion 60, having an open-fronted main body portion 62, which is pivotally connected to underside of lower portion 14 of torso 12 by a suitable spring-ratchet trunnion arrangement 64 for pivoting movement of upper leg portion 60 between any one of a plurality of detent positions about a generally horizontal axis of rotation, as at 66. For a better balance of the robot 10, the foregoing arrangement is such that two upper leg portions 60 diverge somewhat in a downward direction, as is best shown in FIG. 1.

Each leg 24 also includes a lower leg portion 68, having an open-fronted main body portion 70, which is pivotally connected at its upper end to main body portion 62 of upper leg portion 60 by a suitable spring-ratchet trunnion arrangement 72 for pivoting movement of lower leg portion 68 relative to upper leg portion 60 between any one of a plurality of detent positions about a horizontal axis of rotation, as at 74.

Each foot 26, which is fixedly attached to the lower end of main body portion 70 of one of lower leg portions 68, is characterized by a main body portion 76 which defines a partially open-top and open-front-ended vehicle-receiving recess 78. A gate 80, which is pivotally mounted at its lower edge to the main body portion 76, is provided for closing the open-front-end of the vehicle-receiving recess 78 and thus serves as a releasable vehicle-retaining means for the recess 78.

As best shown in FIG. 2, one of the vehicle-receiving clips 50 is provided in each of the open-fronted main body portions 62 and 70 of the upper and lower leg portions 60 and 68, respectively, to define vehicle-receiving recesses 62*a* and 70*a*, which accommodate toy vehicles 82 and 84, respectively. If desired, pivotally mounted covers (not shown) may also be provided for the main body portions 62 and 70 of the upper and lower leg portions 60 and 68, respectively.

Each arm 22 includes an upper arm portion 86 connected to the robot torso 12 and a forearm portion 88 connected to the upper arm portion 86. Each upper arm portion 86 is characterized by an open-faced main body portion 90 which is rotatably connected to a shoulder side of the upper torso portion 16 by a suitable spring-ratchet pivot connection 92 for rotation about a generally horizontal axis between any one of a plurality of detent positions. As illustrated in FIG. 1, one of the vehicle-receiving clips 50, defining a vehicle-receiving recess 90*a*, may be provided in each of the upper arm main body portions 90. Also as illustrated in FIG. 1, a see-through clear plastic cover 96 may be provided for each of the upper arm vehicle-receiving recesses 90*a*. Each cover 96 may be pivotally connected to the upper end of the main body portion 90, as at 98 in FIG. 1. Although not shown in the drawings, a suitable, releasable latch arrangement may be provided for each cover 96 together with a finger-engagable member on each cover 96 to facilitate raising or opening same. Similar covers 96 could also be provided for the upper and lower leg vehicle-receiving recesses 62*a* and 70*a*, respectively.

Depending from the lower end of each upper arm main body portion 90 is a pivot pin 94 upon which is pivotally mounted a yoke member 100 having spaced arm portions 102. Pivotally mounted between the spaced arm portions 102 of each yoke member 100 by suitable spring-ratchet pivot connections 104 is a forearm main body portion 106 which defines a partially open-top and open-front-ended vehicle-receiving recess 108 similar to the vehicle-receiving recesses 78 in the feet 26. A gate 110, which is pivotally connected at its lower edge to the main body portion 106 is provided for closing the open-front-end of the vehicle-receiving recess 108 and thus serves as a releasable vehicle-retaining means. Each forearm main body portion 106 is pivotable on the yoke 100 between any one of a number of spring detent positions as a result of the spring-ratchet pivot connections 104 and is also pivotable with the yoke 100 on the upper arm pivot pin 94.

Figures 3, 4, 5, 6, 7, 8, 9:
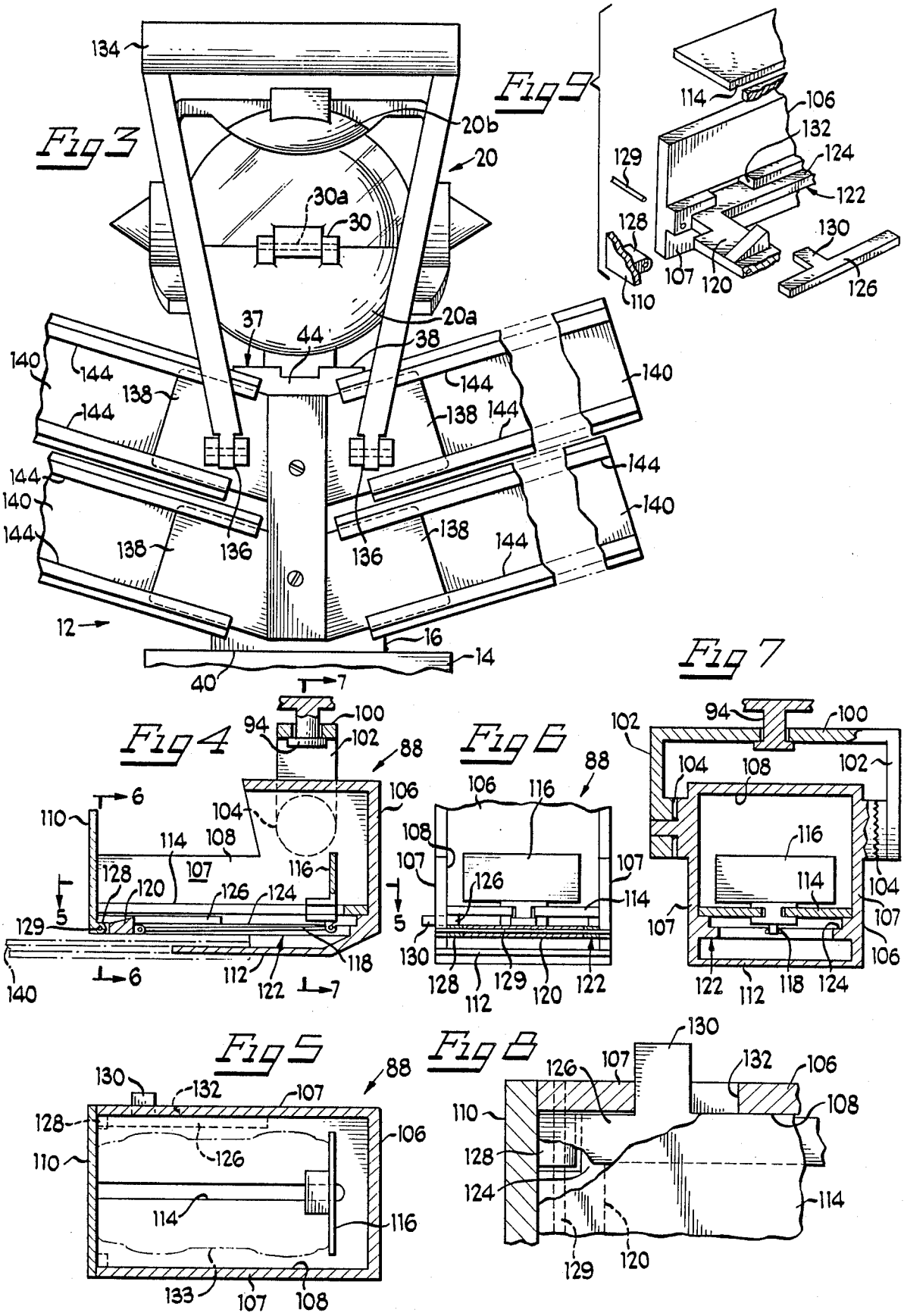
FIG. 3 is a partial rear elevational view of the upper portion of the toy robot vehicle carrier shown in FIG. 1.
FIG. 4 is a vertical sectional view taken generally along line 4—4 of FIG. 1.
FIG. 5 is a horizontal sectional view taken generally along line 5—5 of FIG. 4.
FIG. 6 is a vertical sectional view taken generally along line 6—6 of FIG. 4.
FIG. 7 is a vertical sectional view taken generally along line 7—7 of FIG. 4.
FIG. 8 is an enlarged horizontal sectional view of the upper left corner portion of FIG. 5, partially broken away.
FIG. 9 is an exploded perspective view of the gate-latching structure shown in FIG. 8.

As shown in FIG. 4, a blade-like supporting post 112 projects forwardly from the underside of each forearm main body portion 106 in spaced relation below same for a purpose which will be discussed hereinafter.

As is best illustrated in FIGS. 2, 4, 5, 6, 7, 8 and 9, means are provided in both the foot and forearm vehicle-receiving recesses 78 and 108, respectively, for propelling a vehicle therefrom upon manual unlatching of gates 80 and 110, respectively, unlatched gates 80 and 110 being opened by the exiting vehicles. A longitudinally slotted bottom wall 114 is provided in each of the foot and forearm main body portions 76 and 106 with a vehicle propeller 116 engagable with the rear end of a vehicle being slidable in slotted wall 114. Vehicle propeller 116 is biased forwardly by spring means 118 disposed beneath slotted bottom wall 114 and connected between propeller 116 and a transversely extending cross bar 120 of a fixed sub-floor member 122, to which the gates 80 and 110 are pivotally connected by a pivot pin 129. Sub-floor member 122 also provides a longitudinally extending siderail 124 upon which an elongated trigger/latch member 126 is slidable between a forward latching position (FIGS. 5 and 8) in which its forward end overlies a hinge portion 128 (FIGS. 8 and 9) of the gates 80/110 to releasably latch the gates in an upright closed position and a rearward "release" position free of the gate hinge portion 128, permitting the forwardly biased propeller 116 to force a vehicle against the gates 80/110 to open same with the vehicle then being propelled out the vehicle-receiving recess 78/108 at a relatively rapid rate of speed. As best illustrated in FIGS. 6 and 9, the pivot pin 129 for the gates 80/110 extends through aligned bores provided in sidewalls 77/107 of the foot and forearm main body portions 76/106, the hinge portions 128 of the gates 80/110, and the cross bar 120 of the sub-floor 122. Movement of the trigger/latch member 126 is controlled by a laterally projecting finger-engagable portion 130 which projects outwardly of the feet 26 and forearms 88 through a slot 132 provided in one sidewall 77/107 of the main body portions 76/106 thereof, each slot 132 permitting sufficient forward and rearward movement of the trigger/latch member 126 for latching engagement and disengagement thereof with and from the gate hinge portion 128. Other gate-latching mechanisms could also be utilized.

To position a small free-wheeling vehicle 133 (FIG. 5) in either one of the foot vehicle-receiving recesses 78 or one of the forearm vehicle-receiving recesses 108, first, with the trigger/latch member 126 in its rearward unlatched position, the vehicle propeller 116 is forced rearwardly by the vehicle 133 against the force of the spring means 118. Then the gate 80/110 is pivoted upwardly into its closed position and the trigger/latch member 126 is manually moved forwardly into its gate-latching position whereupon the vehicle 133 is retained between the propeller 116 and either the latched gate 80 or 110.

As best shown in FIG. 2, a carrying handle 134, which extends upwardly and may be movable between two or more positions, is connected to the back of the upper torso portion 16, as at 136, so that the toy robot 10, and any toy vehicles stored in the vehicle-receiving recesses thereof, may easily be transported from one location to another.

Also provided on the back of the upper torso portion 16 are a series of blade-like supporting posts 138, which may be inclined slightly upwardly and to opposite sides of the robot 10 as best illustrated in FIG. 3. The posts 138 are provided for receiving thereon track members 140 for small vehicles, which track members 140 have upstanding curbs 142 on the edges of their upper surfaces and a pair of inwardly-turned flanges 144 facing one another on their undersides. The flanges 144, which are primarily used for interconnecting the track members 140 in a known manner to form curbed roadways upon which small free-wheeling vehicles may be used, fit over the posts 138 for supporting the track members 140 on the robot 10 for either storage or transport from one location to another. As is apparent in FIG. 1, the track members 140, when supported on the posts 138, resemble either wings or epaulets on the toy robot 10.

With reference to FIG. 4, the track members 140 may also be fitted over the blade-like supporting post 112 associated with the forearm vehicle-receiving recess 108 to provide, when the gate 110 is open, a curbed ramp for movement of a toy vehicle from the vehicle-receiving recess 108.

The toy robot vehicle carrier 10 of the present invention not only provides a means for transporting a plurality of small free-wheeling vehicles from one location to another but also a toy which provides play action involving both the toy vehicles and the robot 10 itself due to the provision of the interconnectable track members for forming ramps from certain of the vehicle-receiving recesses and the arrangement for propelling the vehicles from certain of the vehicle-receiving recesses. Further, even without any of the vehicles, for instance should they all become lost or broken, the articulated toy robot 10 of the present invention serves as a very intriguing toy by itself.

While a particular embodiment of the present invention has been shown and described with some possible changes and modifications, further such changes and modifications will occur to those skilled in the art. It is intended in the appended claims to cover all such changes and modifications as fall within the true spirit and scope of the present invention.

What is claimed as new and desired to be secured by Letters Patent is:

1. A robot vehicle carrier comprising:
- a toy robot;
- one or more vehicle-receiving recesses provided on said robot;
- releasable means for retaining a small vehicle in each vehicle-receiving recess;
- a torso;
- a pair of arms connected to said torso;
- an open-ended vehicle-receiving recess provided in at least one of said arms;
- gate means at said open end of said recess for retaining a small vehicle in said recess;
- a forwardly-projecting blade-like supporting post on said arm below a bottom wall of said vehicle-receiving recess and adapted to be grippingly engaged by one end of a track member whereby to define an exit ramp from said recess; and
- at least one blade-like mounting post provided on said robot torso for supporting said track member when not in use.

2. The robot vehicle carrier of claim 1 including releasable spring means in said vehicle-receiving recess in said robot arm for propelling a vehicle received therein from said recess.

3. A robot vehicle carrier comprising:
- a robot having a torso;
- a head connected to said torso;
- a series of limbs connected to said torso;
- a plurality of vehicle-receiving recesses provided in said torso, in said head and in said limbs; and
- releasable means for retaining a small vehicle in each of said recesses.

4. The robot vehicle carrier of claim 3 wherein said limbs comprise:
- a pair of arms; and
- a pair of legs with feet attached.

5. The robot vehicle carrier of claim 4 wherein each robot arm comprises:
- an upper arm portion connected to said robot torso and having a vehicle-receiving recess provided therein;
- means for retaining a small vehicle in said upper arm recess;
- a forearm portion connected to said upper arm portion and having an open-ended vehicle-receiving recess provided therein; and
- gate means at said open end of said recess for retaining a small vehicle in said forearm recess.

6. The robot vehicle carrier of claim 5 wherein spring means are provided in said forearm recess for propelling a vehicle therefrom.

7. The robot vehicle carrier of claim 6 wherein said vehicle-propelling spring means is operable upon being manually triggered.

8. The robot vehicle carrier of claim 4 wherein each robot leg comprises:
- an upper leg portion connected to said robot torso and having a vehicle-receiving recess provided therein;
- means for retaining a small vehicle in said upper leg recess;
- a lower leg portion connected to said upper leg portion and having a vehicle-receiving recess provided therein; and
- means for retaining a small vehicle in said lower leg recess.

9. The robot vehicle carrier of claim 2 wherein each robot foot comprises:
- an open-ended recess for receiving a small vehicle; and
- gate means at said open end of said recess for retaining a small vehicle in said recess.

10. The robot vehicle carrier of claim 9 wherein spring means are provided in said foot recess for propelling a vehicle therefrom.

11. The robot vehicle carrier of claim 10 wherein said vehicle-propelling spring means is manually triggerable.

12. The robot vehicle carrier of claim 4 wherein said torso is hollow and comprises:

a main body portion characterized by integral top, bottom, side and rear walls;

a front wall portion which is pivotally connected at its lower end to said main body portion;

vehicle-receiving recess means associated with said front wall portion; and means for retaining small vehicles in said front wall recess means.

13. The robot vehicle carrier of claim 12 wherein said front wall vehicle-receiving recess means and said retaining means associated therewith are provided on the inner surface of said front wall portion.

14. The robot vehicle carrier of claim 4 including:

interconnectable track members for providing a road bed for small free-wheeling vehicles; and a series of blade-like mounting posts provided on the back of said robot torso for supporting said track members when not in use in a manner such that they project from opposite sides of said torso at upward angles whereby they resemble wings or epaulets.

15. The robot vehicle carrier of claim 5 including a forwardly-projecting blade-like mounting post provided on the underside of at least one of said robot forearms and adapted to be grippingly engaged by one end of a track member whereby to define an exit ramp for a small free-wheeling vehicle from said forearm vehicle-receiving recess when said gate means is open.

16. The robot vehicle carrier of claim 4 wherein said vehicle-receiving recesses provided in said limbs are provided in said arms, said legs and said feet.

17. The robot vehicle carrier of claim 4 wherein said robot head comprises:

a lower portion connected to said robot torso and having a vehicle-receiving recess provided therein; and an upper cover portion which is pivotally connected to said lower portion for retaining a small vehicle in said recess.

18. The robot vehicle carrier of claim 3 including:

interconnectable track members for providing a road bed for small free-wheeling vehicles; and a series of blade-like mounting posts provided on the back of said robot torso for supporting said track members when not in use in a manner such that they project from opposite sides of said torso at upward angles whereby they resemble wings or epaulets.

19. The robot vehicle carrier of claim 3 including a carrying handle connected to said robot torso for transporting said robot vehicle carrier and any vehicles received in said recesses from one location to another.

20. The robot vehicle carrier of claim 3 including means on said robot for supporting one or more small-vehicle track members.

* * * * *